US006020870A

United States Patent [19]

Takahashi et al.

[11] Patent Number: 6,020,870

[45] Date of Patent: Feb. 1, 2000

[54] LIQUID CRYSTAL DISPLAY APPARATUS AND DRIVING METHOD THEREFOR

[75] Inventors: Seiki Takahashi; Yukiji Ohno, both of Kikuchi-gun, Japan

[73] Assignee: Advanced Display Inc., Kumamoto, Japan

[21] Appl. No.: 08/769,053

[22] Filed: Dec. 18, 1996

[30] Foreign Application Priority Data

Dec. 28, 1995 [JP] Japan ..... 7-343221

[51] Int. Cl.[7] ..... G09G 3/36

[52] U.S. Cl. ..... 345/92; 345/94

[58] Field of Search ..... 345/87, 90, 92, 345/94, 96, 99, 55, 208, 209; 349/37, 39, 42, 46, 54

[56] References Cited

U.S. PATENT DOCUMENTS 5,165,075 11/1992 Hiroki et al. ..... 345/92
5,841,415 11/1998 Kwon et al. ..... 345/92
5,852,425 12/1998 Bird et al. ..... 345/92

FOREIGN PATENT DOCUMENTS 8-292416 11/1996 Japan .

*Primary Examiner*—Dennis-Doon Chow
*Attorney, Agent, or Firm*—Burns, Doane, Swecker & Mathis, LLP

[57] ABSTRACT

A method of driving a liquid crystal material in a liquid crystal display apparatus comprising steps of:

(1) charging a drain electrodes; (2) retaining a drain voltage; and (3) letting the thin film transistors ON-state, which comprises a step of: reducing a horizontal crosstalk by setting the gate voltage so as to complete charging the drain electrode within the gate selecting period; and by recovering fluctuation of a storage capacitance voltage within the gate selecting period.

8 Claims, 9 Drawing Sheets source voltage gate voltage
(n line)

drain voltage
(n line)

gate voltage
((n + 1) line)

drain voltage
((n + 1) line)

storage capacitance
electrode voltage
(n line)

storage capacitance
electrode voltage
((n + 1) line)

source voltage gate voltage
(n line)
tH1
tH2
Vg+1
Vg+2
Vgdrain voltage
(n line)

gate voltage
((n + 1) line)
tH1
tH2
Vg+1
Vg+2
Vgdrain voltage
((n + 1) line)

storage capacitance
electrode voltage
(n line)

storage capacitance
electrode voltage
((n + 1) line)

FIG. 5(a)
CONVENTIONAL
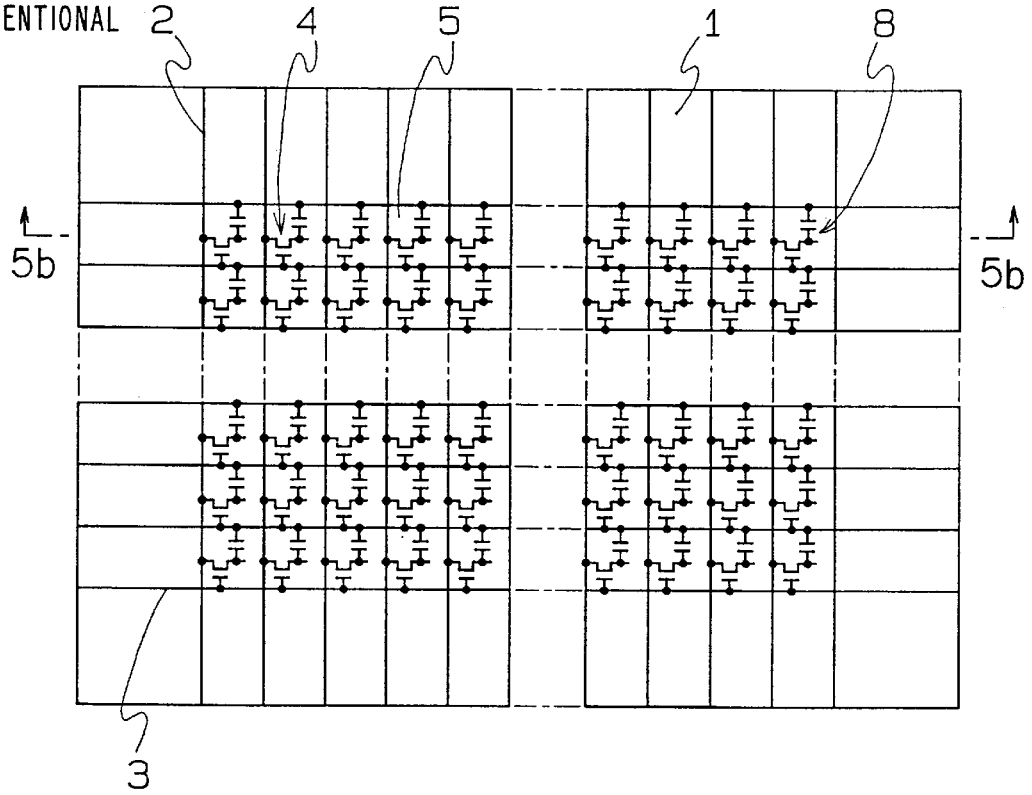
FIG. 5(b)
CONVENTIONAL
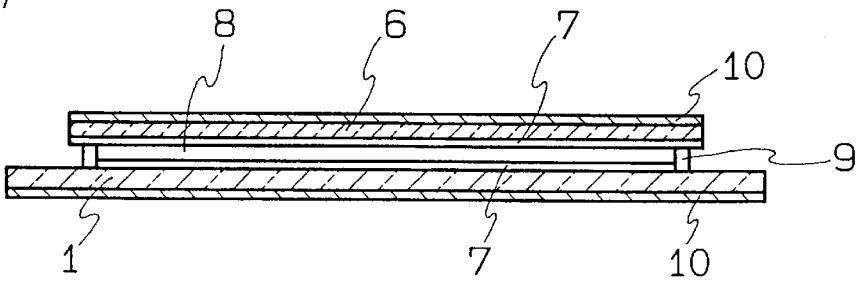

FIG. 6(a)
CONVENTIONAL
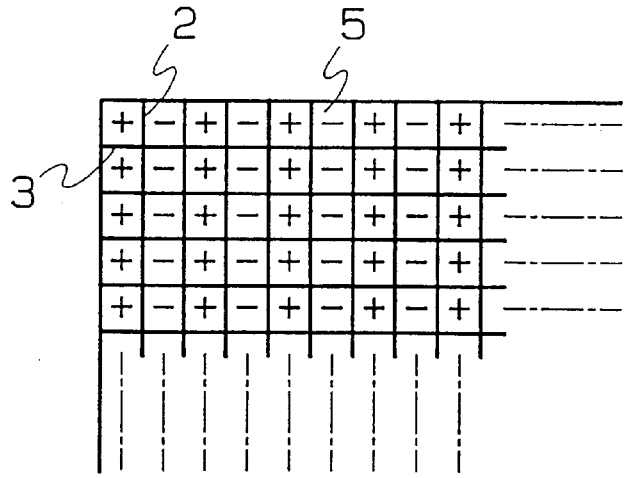
FIG. 6(b)
CONVENTIONAL
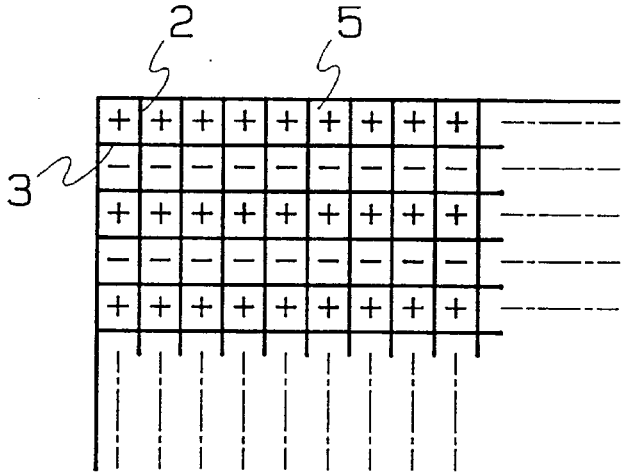
FIG. 6(c)
CONVENTIONAL
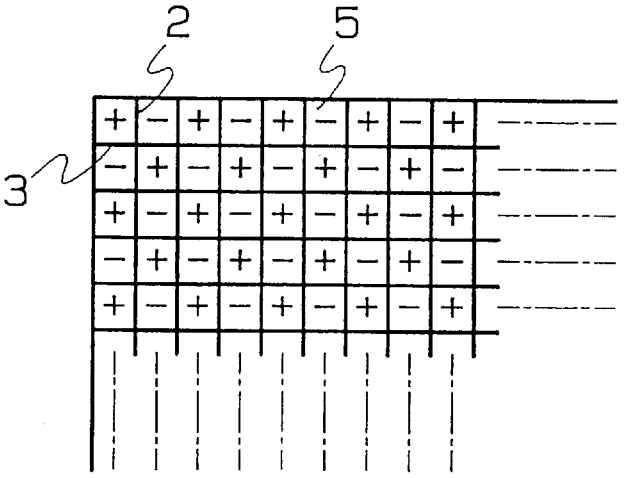

FIG. 7
CONVENTIONAL
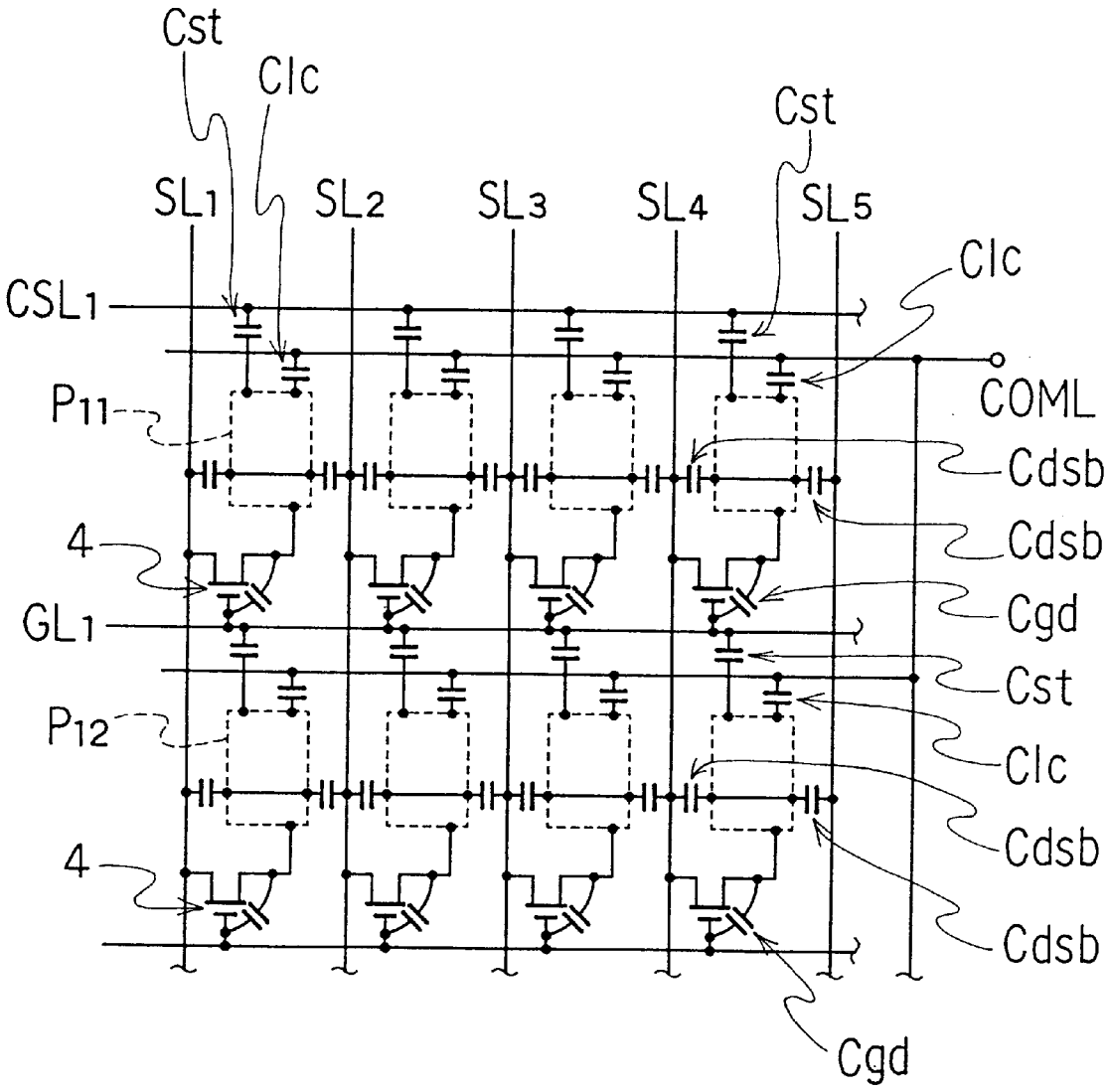

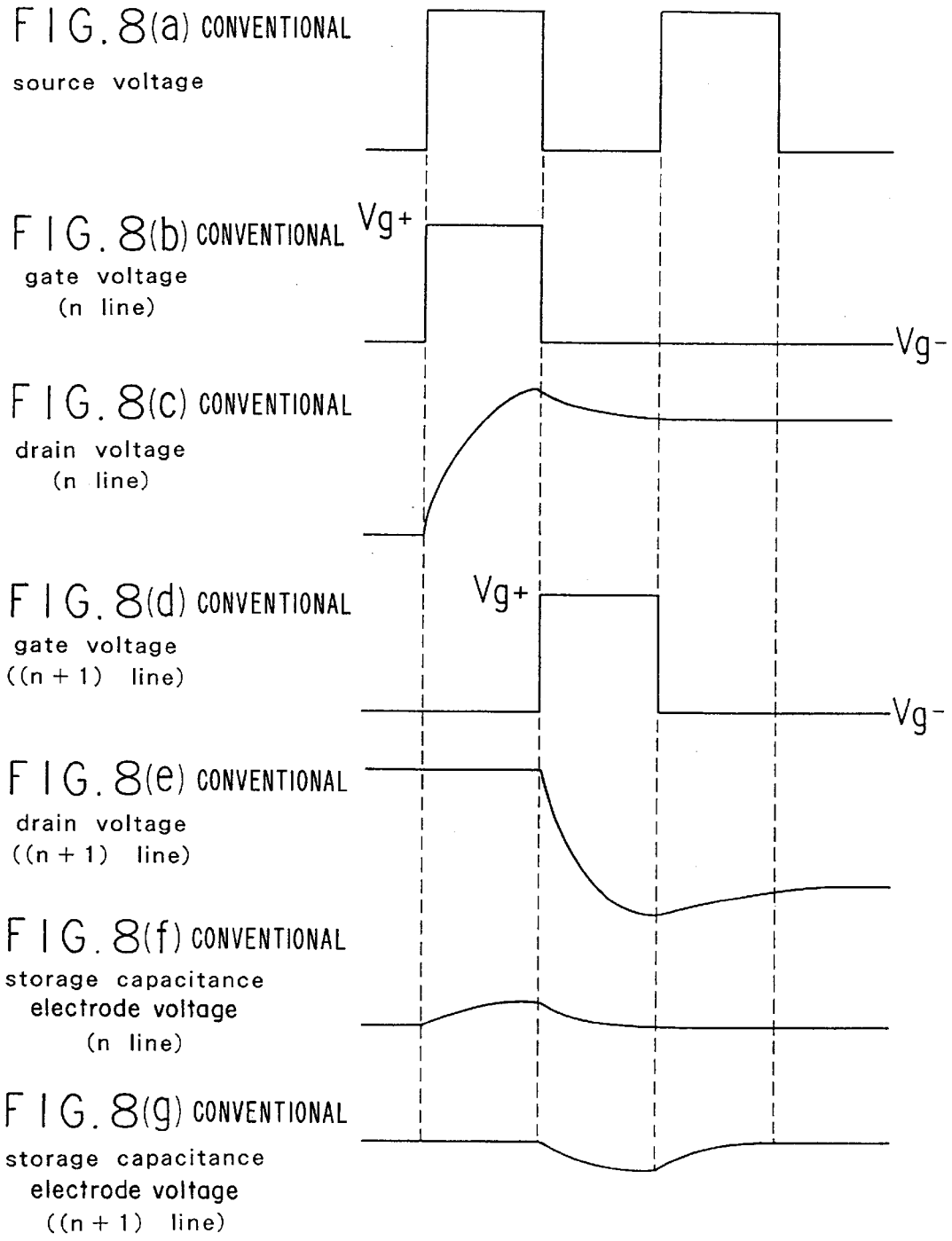
FIG. 8(a) CONVENTIONAL
source voltage
FIG. 8(b) CONVENTIONAL
gate voltage
(n line)
Vg+
Vg-
FIG. 8(c) CONVENTIONAL
drain voltage
(n line)
FIG. 8(d) CONVENTIONAL
gate voltage
((n + 1) line)
Vg+
Vg-
FIG. 8(e) CONVENTIONAL
drain voltage
((n + 1) line)
FIG. 8(f) CONVENTIONAL
storage capacitance
electrode voltage
(n line)
FIG. 8(g) CONVENTIONAL
storage capacitance
electrode voltage
((n + 1) line)

FIG. 9(a)
CONVENTIONAL
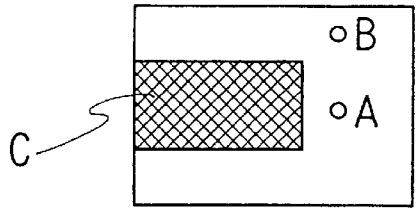
FIG. 9(b) CONVENTIONAL
black display
source voltage
FIG. 9(c) CONVENTIONAL
gray display
source voltage
FIG. 9(d) CONVENTIONAL
storage capacitance
electrode voltage
at the position B
FIG. 9(e) CONVENTIONAL
storage capacitance
electrode voltage
at the position A
FIG. 9(f) CONVENTIONAL
drain voltage at
the position A, B
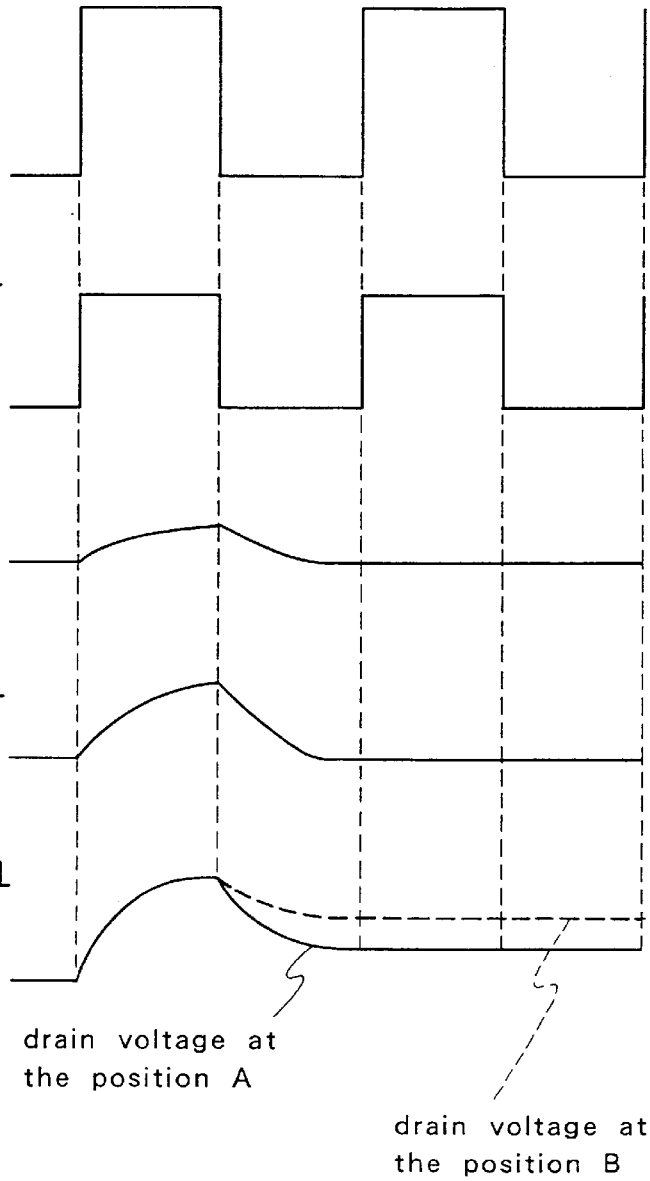

LIQUID CRYSTAL DISPLAY APPARATUS AND DRIVING METHOD THEREFOR

BACKGROUND OF THE INVENTION

The present invention relates to an active-matrix type liquid crystal display (hereinafter referred to as an LCD) apparatus in which a thin film transistor (hereinafter referred to as a TFT) is provided and to a method of driving the active-matrix type LCD apparatus, and more particularly to an LCD apparatus wherein picture quality is enhanced.

A diagram of an equivalent circuit of a TFT type liquid crystal display panel in a conventional LCD is illustrated in FIG. 5(*a*) and a cross-sectional view taken along a line A—A in FIG. 5(*a*) is illustrated in FIG. 5(*b*). In FIG. 5(*a*) and FIG. 5(*b*), reference numeral 1 indicates a TFT array substrate (hereinafter, referred to as an array substrate), reference numeral 2 indicates a plurality of source lines, reference numeral 3 indicates a plurality of gate lines, reference numeral 4 indicates a TFT, reference numeral 5 indicates a pixel, reference numeral 6 indicates an opposite substrate which is oppositely disposed against the array substrate 1, reference numeral 7 indicates an alignment layer (a film for alignment), reference numeral 8 indicates a liquid crystal material, reference numeral 9 indicates a sealing material, reference numeral 10 indicates a polarizer.

As shown in FIG. 5(*a*) and FIG. 5(*b*), a plurality of source lines 2 and a plurality of gate lines 3 are provided on the array substrate 1 made of a transparent material such as glass and so forth so that an electrical insulating film (not shown in FIG. 5(*a*) and FIG. 5(*b*) made of silicon nitride and so forth intervenes between a first plane on which source lines are provided and a second plane on which gate lines are provided and so that the source lines are crossed by the gate lines at right angle. The source lines and the gate lines are made of a metal such as aluminum and so forth. TFTs 4 are provided respectively at each intersecting portion at which the source line and the gate line intersect with each other to form the pixel 5. Further, the alignment layer 7 is provided over both the surface of the portion in the array substrate 1 on which a plurality of pixels 5 are provided and all the upper surface of the opposite substrate 6 which is oppositely disposed against the array substrate. The above-mentioned portion in the array substrate 1 on which a plurality of pixels are provided corresponds to a display area. The liquid crystal material 8 is sandwitched between the array substrate 1 and the opposite substrate 6. Then the clearance space between the two substrates, that is, the array substrate and the opposite substrate is sealed with the sealing material 9 to form a liquid crystal display panel. Further, the two polarizers 10 are provided respectively on each outside surface of the liquid crystal display panel.

In general, with regard to a driving technique for the above-mentioned TFT type LCD, three driving techniques with respect to applying a source voltage to be inputted to each pixel are proposed. Each schematic diagram for illustrating such three driving techniques is shown respectively in FIG. 6(*a*), FIG. 6(*b*) and FIG. 6(*c*). In FIG. 6(*a*) through FIG. 6(*c*), the same reference numeral indicates respectively the same portion in FIG. 5(*a*) and FIG. 5(*b*). Each of FIG. 6(*a*), FIG. 6(*b*) and FIG. 6(*c*) shows respectively a polarity of a voltage applied to each pixel in one frame period. In the next frame period, a voltage having the opposite polarity (opposite to the above-mentioned polarity) is inputted. A polarity of a voltage means that a voltage is either positive or negative. In FIG. 6(*a*) through FIG. 6(*c*), an indication "+" means that a positive voltage is applied and an indication "−" means that a negative voltage is applied.

In a driving technique illustrated in FIG. 6(*a*), a voltage having the same polarity (for example, a positive voltage) is applied to each of the pixels 5 arranged in vertical direction (direction along the source line 2) and a voltage having the opposite polarity (for example, a negative voltage) is applied to each of the pixels arranged on the next line toward the horizontal direction (direction along the gate line 3). In a driving technique illustrated in FIG. 6(*b*), a voltage having the same polarity is applied to each of the pixels arranged in horizontal direction (direction along the gate line 3) and a voltage having the opposite polarity (opposite to the above-mentioned polarity with respect to FIG. 6 (*b*)) is applied to each of the pixels arranged on the next row toward vertical direction (direction along the source line 2). Further, in a driving technique illustrated in FIG. 6(*c*), a voltage having one polarity is applied to one pixel and a voltage having the opposite polarity is applied to pixels which are immediately adjacent to the above-mentioned one pixel on the panel with respect to FIG. 6(*c*). As described above, the reason why the polarities of the input voltages are not the same is because flickers which are derived from compensation effect caused by the voltage having the opposite polarity, and variation in luminance are intended to be decreased.

FIG. 7 is an equivalent circuit diagram illustrating in detail the TFT type LCD shown in FIG. 5. In general, the TFT 4 is provided one by one in each of the pixels each of which is defined as an area which is formed by being divided by gate lines $GL_1$, $GL_2$, . . . , $GL_m$ (m is an integer) and source lines $SL_1$, $SL_2$, . . . , $SL_n$ (n is an integer) intersecting to the gate lines. The TFT 4 is controlled by on-off control. The integer m is 600 and the integer n is 2400. The liquid crystal material is driven by charging a source voltage to a pixel electrode which is connected to a drain electrode in a TFT 4. The pixel electrode is connected to a common electrode, namely, COML through a layer comprising the liquid crystal material. Further, the pixel electrode is also connected to a storage capacitance electrode $CSL_1$ through a storage capacitance. The storage capacitance Cst is a capacitance for retaining storaged on a pixel electrode and is formed by an insulating layer between the pixel electrode and the storage capacitance electrode. A voltage applied to a drain electrode, that is, a drain voltage is retained by the storage capacitance Cst and by a liquid crystal material capacitance C*l* c till the next charging is performed and the drain voltage drives the liquid crystal material. The storage capacitance electrode $CSL_1$ is provided along the horizontal direction, that is, parallel to the gate line. Each of the gate lines $GL_1$, $GL_2$, . . . , $GL_m$ is connected to an output terminal of a driving IC independently with each other; each of the source lines $SL_1$, $SL_2$, . . . , $SL_n$ is connected to an output terminal of a driving IC independently with each other; storage capacitance electrodes $CSL_1$ are connected outside of a display area. A driving technique wherein a voltage having the same polarity is applied to each of the pixels arranged in horizontal direction (direction along the gate line 3) and a voltage having the opposite polarity (opposite to the above-mentioned polarity with respect to FIG. 6(*b*)) is applied to each of the pixels arranged on the next row toward vertical direction (direction along the source line 2) is illustrated referring to FIG. 6(*b*) and is hereinafter referred to as a line inversion driving technique. On the other hand, a technique wherein voltages to be inputted to the storage capacitance electrode and to the opposite electrode both illustrated in FIG. 7 are set at the same frequency and are set at the inversion phase to each other, is hereinafter referred to as a common inversion driving technique. The common inversion driving technique can be incorporated into the line inversion driving technique. The combined driving technique is hereinafter referred to as a line common inversion driving technique. According to the line common inversion driving technique, a source driving voltage can be decreased with the aid of a voltage appearing at the storage capacitance electrode (hereinafter, referred to as a storage voltage capacitance voltage) and with the aid of the voltage applied to the opposite electrode. The polarity of the storage capacitance voltage is inversed to the opposite polarity in each period for gate selecting (hereinafter, referred to as a gate selecting period). Accordingly, an inexpensive driving IC for a source electrode with a low driving voltage can be adopted and the power consumption can be decreased.

Waveforms of the source voltage, of the gate voltage, of the drain voltage and of the storage capacitance electrode voltage are shown respectively in FIG. 8(*a*) through FIG. 8(*g*). In FIG. 8(*a*) through FIG. 8(*g*), the source voltage is inversed alternately in each gate selecting period. The source voltage is illustrated in FIG. 8(*a*). If the gate voltage is ON-state (the gate voltage is $Vg^+$ state), the source voltage is applied to the drain electrode by an ON-state current of the TFT corresponded to the drain electrode. A characteristic wherein such voltage applied to the drain electrode, that is, the drain voltage increases within a certain period is in general referred to as a charging characteristic concerning the TFT. In FIG. 8(*b*) through FIG. 8(*e*), supposing that n represents a positive integer, concerning both a pixel on the n-th gate line (hereinafter referred to as an n line) and a pixel on the (n+1)-th gate line (hereinafter referred to as an (n+1) line), the gate voltages applied to the above-mentioned two pixels respectively and the drain voltages applied to the above-mentioned two pixels respectively are illustrated. If a gate voltage is inputted to the n line (see FIG. 8(*b*)), for example, a positive voltage is inputted as the drain voltage for the n line, as shown in FIG. 8(*c*). A gate voltage shown in FIG. 8(*d*) is applied to as a drain voltage inputted into the (n+1) line and at the same time, a negative voltage having the polarity opposite to the n line, as shown in FIG. 8(*e*) is applied, since the line inversion driving technique is adopted. Thus, since the liquid crystal display apparatus illustrated in FIG. 8(*a*) through FIG. 8(*g*) adopts the line inversion driving technique, concerning two pixels immediately adjacent to each other among pixels arranged in vertical direction, a given voltage is applied to one pixel and a given voltage having the polarity opposite to the above is applied to the other. After that, each voltage is retained till in turn the each opposite voltage is applied after one frame period. So as to explain simply, the description of a waveform fluctuation caused under the influence of a parasitic capacitance Cgd between the gate electrode and the drain electrode shown in FIG. 7 and the influence of a parasitic capacitance Cdsb between the drain electrode and the source electrode is omitted. Further, the voltage inputted to the opposite electrode is direct current (not shown in Figures).

An expression "to charge" represents "to apply a second voltage to an electrode which is kept at a first voltage", where the second voltage can be usually positive and can be occasionally negative. Accordingly, the expression "to charge" is employed in both cases; the first case is that the first voltage is higher than the second voltage and the second case is that the first voltage is lower than the second voltage.

Since a storage capacitance electrode $CSL_1$ is coupled to the drain electrode in the TFT 4 through the storage capacitance Cst, as shown in FIG. 7, a waveform of a storage capacitance voltage is distorted under a coupling effect from the drain voltage, as the waveform of the storage capacitance electrode voltage is shown in FIG. 8(*f*) and FIG. 8(*g*). Firstly, in a gate-on period, a storage capacitance voltage (n line) increases with a drain voltage or decreases with a drain voltage (n+1 line). Since charging a drain electrode is completed at the conclusion of the gate-on period (a gate-on period in which the gate voltage is $Vg^+$, a gate-on period is also referred to as a gate selecting period), the storage capacitance voltage is varied decreased by an amount of storage capacitance electrode against an input voltage at the instant when the gate electrode becomes OFF-state. After that, the storage capacitance voltage is recovered up to the input voltage at the gate-off state. Since during the gate until period the TFT is kept at a high resistance state, the drain voltage is varied under a coupling effect from fluctuation of the storage capacitance electrode voltage. Accordingly, there is a problem that the drain voltage decreases with the storage capacitance electrode voltage (n line) and increases with the storage capacitance electrode voltage (n+1 line) and as a result a crosstalk occurs.

Next, a mechanism wherein a horizontal crosstalk occurs under the influence of fluctuation of a voltage appeared by a coupling capacitance is illustrated referring to FIG. 9(*a*) through FIG. 9(*f*). FIG. 9(*a*) illustrates a plan view of a test-pattern. A case wherein a pattern C represents a test pattern of black display on a display screen of which the background is gray is explained hereinafter. Since all the pixels on one gate line are connected, as shown in FIG. 7, to one storage capacitance electrode, with respect to storage capacitances arranged along a horizontal direction, if a test-pattern shown in FIG. 9(*a*) is displayed, a distortion of a voltage wavefrom at a position A and a distortion of a voltage waveform at a position B vary to each other. This variation results in a difference in luminance between the position A and the position B and appears to be a horizontal crosstalk visually. A voltage at the position A and a voltage at the position B to display this test pattern is explained hereinafter. A displaying mode for a liquid crystal display panel is supposed to be normally white mode. Further, a pixel electrode on the position B is at the upper position than a pixel electrode on the position A and connected to one source line commonly.

FIG. 9(*b*) illustrates a source voltage in black display and FIG. 9(*c*) illustrates a source voltage in gray display. As is shown in FIG. 9(*b*) and FIG. 9(*c*), a voltage of an amplitude of a source signal in black display is larger than a voltage of an amplitude of a source signal in gray display. Accordingly, with respect to a voltage applied to pixel electrodes $P_{11}$ and $P_{12}$ and so on connected to one storage capacitance electrode through a storage capacitance, a voltage storage capacitance electrode at the position A is larger than a voltage at the position B. FIG. 9(*d*) illustrates a storage capacitance electrode voltage at the position B, similarly, FIG. 9(*e*) illustrates a storage capacitance voltage at the position A. Further, FIG. 9(*f*) illustrates a drain voltage at the position A and a drain voltage at the position B. As a result, a fluctuation of a storage capacitance electrode voltage at the position A (see FIG. 9(*e*)) is larger than a fluctuation of a storage capacitance electrode voltage at the position B. Further, a drain voltage achieved after being varied under the coupling effect caused by the fluctuation of the storage capacitance electrode voltage is varied. In this case, since if a positive voltage is applied, a finally achieved drain voltage at the position A (shown with a full line in FIG. 9(*f*)) is lower than a finally achieved drain voltage at the position B (shown with a dashed line in FIG. 9(*f*)), a voltage to be applied to the layer comprising the liquid crystal material also becomes lower, and a brightness of display at the position A gets brighter than a brightness of display at the position B.

Similarly, with a test pattern of white on the diaplay screen of which the background is gray, since a fluctuation of a storage capacitance voltage at the position A is smaller than a fluctuation of a storage capacitance voltage at the positon B, and a finally achieved drain voltage at the position A is higher than a finally achieved drain voltage at the position B, a brightness of display gets dark. Further, also in driving by line common inversion driving technique, the same fluctuation of a voltage occurs as in driving by line inversion technique.

As described above, the cause of a horizontal crosstalk occurring in a conventional TFT type liquid crystal display panel is fluctuation of a storage capacitance voltage. So as to reduce the fluctuation of the storage capacitance electrode voltage, two ideas are suggested, that is, one idea is that a value of a storage capacitance is lowered and another idea is that recovery from the varied state is made faster by lowering the resistance of the storage capacitance electrode. However, since reducing the storage capacitance leads to deterioration of the characteristic of retaining a voltage applied to the liquid crystal material and also leads to increment of an influence of parasitic capacitances Cgd and Cdsb, the storage capacitance cannot be reduced to so small. On the other hand, since adaptable resistance values for bus line materials are limited, reducing the value of the electrical resistance of storage capacitance electrode line to be lower than the present designed value has become difficult under the circumstance that a resolution of the liquid crystal panel becomes enhanced.

It is an object of the present invention to eliminate the above-mentioned problem, and to provide a liquid crystal display apparatus capable of reducing a horizontal crosstalk and a method of driving the liquid crystal display apparatus.

SUMMARY OF THE INVENTION

According to one aspect of the present invention, there is provided a method of driving a liquid crystal material in a liquid crystal display apparatus comprising steps of:

(1) charging a drain electrode of a thin film transistor with a source voltage by applying a gate voltage to a gate electrode of the thin film transistor and controlling the thin film transistor;

(2) retaining a drain voltage with the aid of a storage capacitance and a liquid crystal material capacitance; and (3) letting the thin film transistors ON-state by applying a voltage to the gate electrode in the thin film transistor and by inversing polarity of the source voltage in each gate selecting period, which comprises a step of:
reducing a horizontal crosstalk
by setting the gate voltage so as to complete charging the drain electrode within a shorter period compared with the gate selecting period; and
by recovering storage capacitance voltage up to the input (source) voltage within the gate selecting period.

Preferably, the gate voltage is set at a level so that the level is higher than a set voltage wherein charging the drain voltage is completed at the end of the gate selecting period.

Preferably, the gate selecting period is divided to two periods and a gate voltage in a first period is set at a voltage value wherein charging the drain electrode within the first period; and a gate voltage in a second period is set at a voltage value wherein an electrical resistance necessary for retaining a finally reached drain voltage value in the first period is realized.

Preferably, the gate selecting period is divided to three or more periods wherein the gate voltage in a first period is set at a voltage value in which charging the drain electrode is completed within the first period; a gate voltage in a second period is set at a voltage value which is lower than a voltage in the first period and realizes an electrical resistance necessary for retaining finally reached drain voltage value in the first period; and a gate voltage in a third or latter period is set similarly.

According to another aspect of the present invention, there is provided a liquid crystal display apparatus comprising: a plurality of source lines, a plurality of gate lines, a gate insulating film, a thin film transistor, a drain electrode, a liquid crystal material, a storage capacitance, a capacitance formed by the liquid crystal material; a plurality of gate lines being formed in horizontal direction; a plurality of source lines being formed in vertical direction; the gate line and the source line intersecting at a right angle through the gate insulating film; the thin film transistor being connected to each intersecting portion where the gate line and the source line intersect; drain voltage being retained by the storage capacitance and by the capacitance formed by the liquid crystal material, wherein storage capacitance voltage is recovered up to the input (source) voltage within a gate selecting period by setting a gate voltage so as to charge the drain electrode within the gate selecting period.

Preferably, the gate voltage is set at a level higher than a voltage level wherein charging the drain electrode is completed at the conclusion of the gate selecting period.

Preferably, the gate selecting period is divided to two periods and a gate voltage in a first period is set at a voltage value wherein charging the drain electrode is completed within the first period; and a gate voltage in a second period is set at a voltage value wherein an electrical resistance necessary for retaining a finally reached drain voltage value in the first period is realized.

According to another aspect of the present invention, there is provided a liquid crystal display apparatus comprising: a plurality of source lines, a plurality of gate lines, a gate insulating film, a thin film transistor, a drain electrode, a liquid crystal material, a storage capacitance, a capacitance formed by the liquid crystal material; the plurality of gate lines being formed in horizontal direction; the plurality of source lines being formed in vertical direction; the gate line and the source line intersecting at a right angle through the gate insulating film; the thin film transistor being connected to each intersecting portion where the gate line and the source line intersect; drain voltage being retained by the storage capacitane and by the capacitance formed by the liquid crystal material, wherein a width of a source electrode and a distance between the source electrode and the drain electrode are determined so as to charge the drain electrode within a shorter period compared with the gate selecting period.

BRIEF DESCRIPTION OF THE DRAWINGS

FIG. 1(*b*) is a cross sectional view illustrating the liquid crystal display apparatus according to the present invention;

FIG. 5(*a*) is a diagram illustrating an equivalent circuit of the TFT type liquid crystal display panel of the conventional LCD;

FIG. 5(*b*) is a cross sectional view of the conventional liquid crytal display panel;

FIG. 6(*a*) through FIG. 6(*c*) illustrate respective techniques of driving the conventional TFT type LCD wherein source voltages inputted to each pixel are different from each other;

FIG. 7 is a detailed diagram illustrating the equivalent circuit shown in FIG. 5(*a*);

FIG. 8(*a*) through FIG. 8(*g*) illustrate respectively waveforms of the source voltage, of the gate voltage, of the drain voltage and of the storage capacitance voltage in a line inversion driving technique according to the conventional method of driving the liquid crystal display apparatus;

FIG. 9(*a*) is a plan view illustrating a test pattern display screen by a line inversion driving technique in the conventional liquid crystal display apparatus; and FIG. 9(*b*) through FIG. 9(*f*) illustrate respectively waveforms of the source voltage, of the gate voltage, of the drain voltage and of the storage capacitance voltage in a line inversion driving technique according to the conventional method of driving the liquid crystal display apparatus.

DETAILED DESCRIPTION

A liquid crystal display apparatus according to the present invention is explained hereinafter referring to accompanied drawings.

Figure 4:
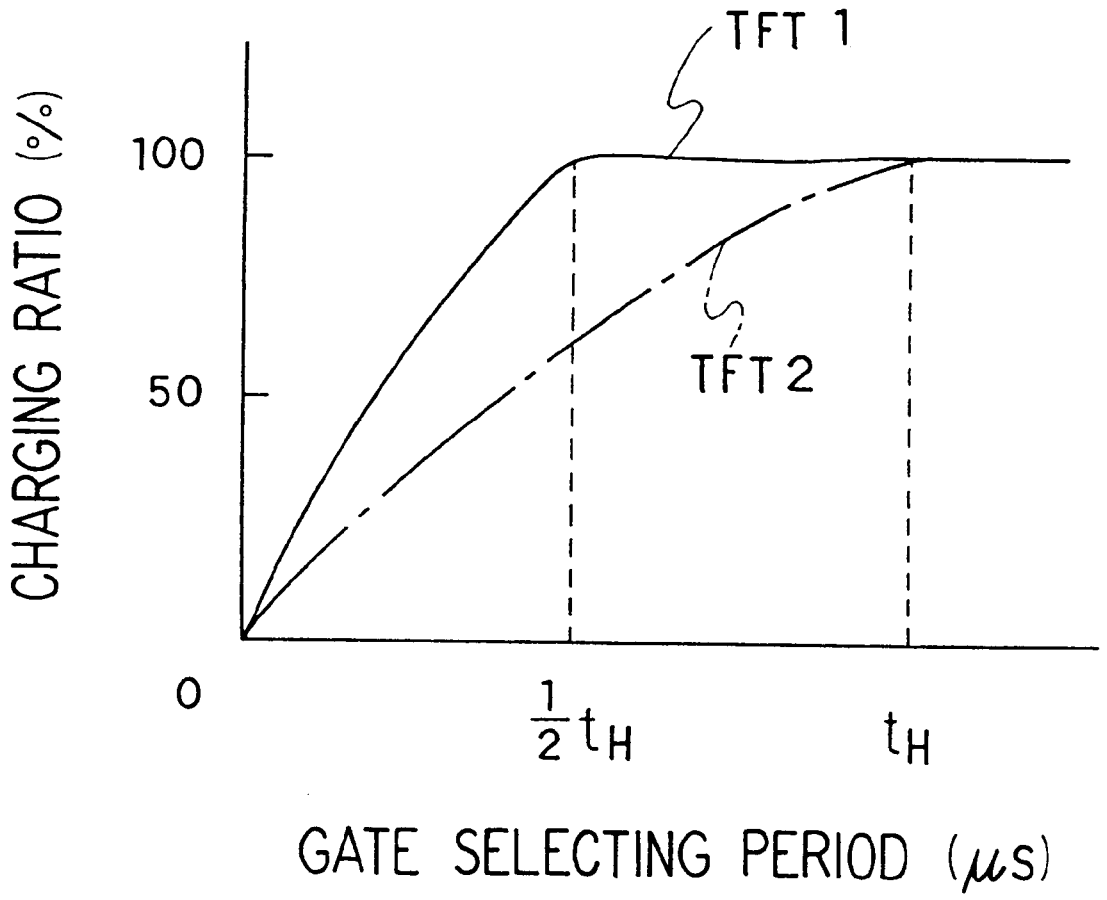
FIG. 4 illustrates a characteristic of a charging ratio versus a gate selecting period of the TFT according to the present invention in comparison with a characteristic of a charging ratio versus a gate selecting period of the conventional TFT.

FIG. 4 illustrates a characteristic of a charging ratio versus a gate selecting period of a TFT.

In FIG. 4, the charging ratio is represented in a formula (1):

$$\text{(a drain voltage)/(a source voltage)} \quad (1)$$

The above formula (1) equals namely to below:

$$\text{(a charged voltage)/(an inputted voltage)}$$

The characteristic shown in FIG. 4 of a charging ratio versus a gate selecting period is determined on the basis of an ON-state resistance in the TFT and a load capacitance. Here, the phrase "an ON-state resistance" means an electrical resistance between a source electrode and a drain electrode when the TFT is kept at ON-state level. That is, a phrase "an ON-state resistance" means an electrical resistance between a source electrode and a drain electrode during a gate selecting period. Next, a phrase "a load capacitance" means a load capacitance connected to the drain electrode in a TFT. The load capacitance is charged by a current between a source electrode and a drain electrode during a gate selecting period. In case of an actual liquid crystal display apparatus, the load capacitance equals to a parallel synthesized capacitance between Cst and C*l* c. A period during which the charging ratio reaches to 100% is defined as a charging time.

According to conventional design principles for a TFT, as TFT 2 indicated with an alternate long and short dashed line is shown in FIG. 4, since the charging time is designed so that the charging time can correspond approximately to a gate selecting period $t_H$ equal to the gate-on period of a liquid crystal display apparatus. However, in driving by the line inversion driving technique and the line common inversion driving technique, if the charging time is designed so that the charging time can correspond to a gate selecting period, a pixel voltage (namely, a drain voltage) is influenced by a storage capacitance electrode voltage varied under a coupling effect from a storage capacitance of a pixel. If charging the pixel electrode is completed before the end of a gate selecting period, a recovery of a storage capacitance voltage becomes possible and fluctuation of a pixel voltage (a voltage appeared on a pixel electrode) becomes smaller. Accordingly, in driving by the driving method of the liquid crystal display apparatus according to the present invention, to complete charging a pixel electrode during half a period of $t_H$ as in a TFT shown with a full line indicating TFT 1 is the characteristic concerning the present invention.

Figures 2A, 2B, 2C, 2D, 2E, 2F, 2G:
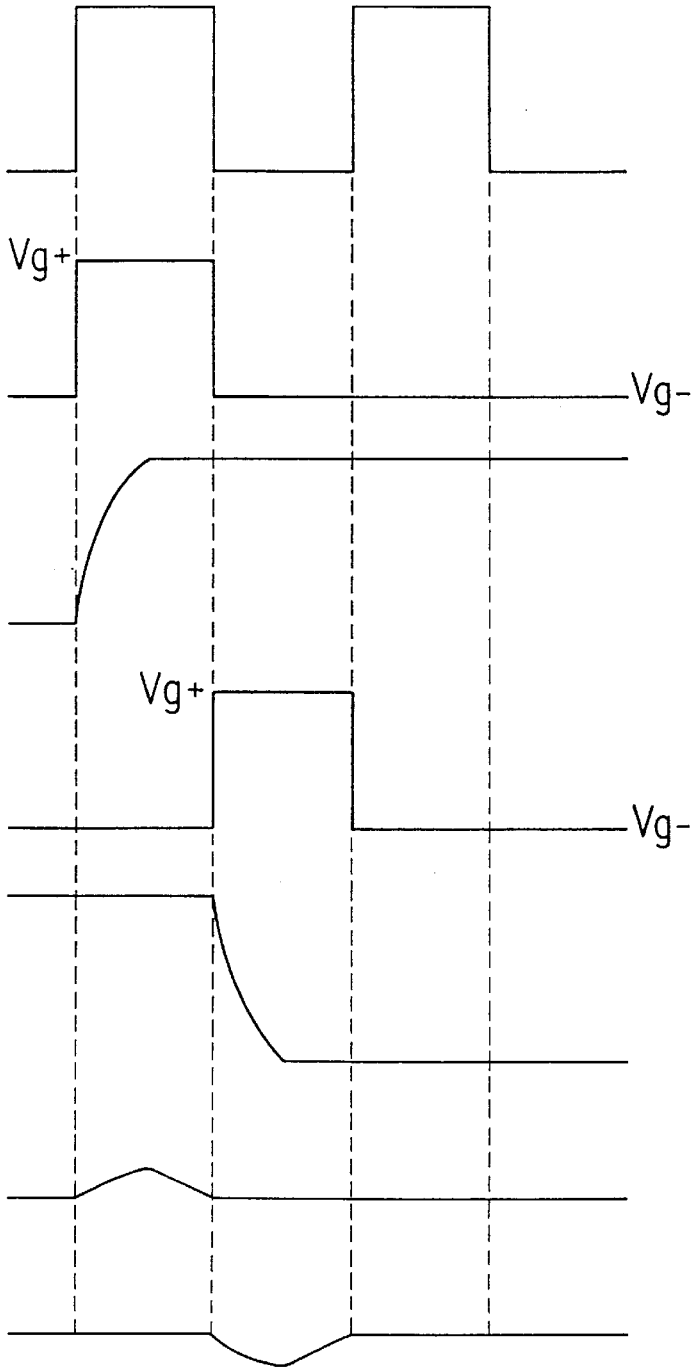
FIG. 2(*a*) through FIG. 2(*g*) illustrate respectively waveforms of the source voltage, of the gate voltage, of the drain voltage and of the storage capacitance voltage in a line inversion driving technique according to one embodiment of a method of driving the liquid crystal display apparatus of the present invention.

Next, a method of driving a liquid crystal display apparatus according to the present invention is explained referring to accompanied drawings FIG. 2(*a*) through FIG. 2(*g*). FIG. 2(*a*) through FIG. 2(*g*) illustrate respectively waveforms of the source voltage, of the gate voltage, of the drain voltage and of the storage capacitance electrode voltage in a line inversion driving technique when a charging time is set so that the charging time is $(\frac{1}{2})\times t_H$.

FIG. 2(*a*) illustrates a souce voltage; FIG. 2(*b*) illustrates a gate voltage for an n line; FIG. 2(*c*) illustrates a drain voltage for an n line; FIG. 2(*d*) illustrates a gate voltage for an n+1 line; FIG. 2(*e*) illustrates a drain voltage for an n+1 line; FIG. 2(*f*) illustrates a storage capacitance electrode voltage for an n line; FIG. 2(*g*) illustrates a storage capacitance electrode voltage for an n+1 line. In case shown in FIG. 2(*a*) through FIG. 2(*g*), since a charging time for a TFT is half of the conventional charging time (see TFT 2 in FIG. 4 as a conventional charging time), the drain voltage is charged during half of the gate selecting period as shown in FIG. 2(*c*) and in FIG. 2(*e*). The storage capacitance voltage derived from a coupling effect by the drain voltage is varied with a variation of a charging time for the drain electrode. However, since the charging time for a drain voltage is half of a gate-on period, the fluctuation of the storage capacitance electrode voltage is ended during half of a gate-on period. After that, fluctuation of the storage capacitance electrode voltage is decreased to zero level, and the storage capacitance voltage is recovered approximately up to the level of the input voltage (source) when the gate-on period is completed, as shown in FIG. 2(*f*) and in FIG. 2(*g*). Under the condition shown in FIG. 2(*a*) through FIG. 2(*g*) and described above, if a test pattern shown in FIG. 9(*a*) is displayed, since the fluctuation of the storage capacitance electrode voltage is suppressed as a whole, a difference in a drain voltage between a point A and a point B becomes small, a difference in brightness given by the display becomes small.

Next, a variation of a crosstalk ratio and a variation of a contrast ratio when a gate-on voltage $Vg^+$ related to a characteristic of charging in a TFT is increased are explained referring to Table 1. The above-mentioned crosstalk ratio is defined so that a difference between a luminance in a background display for a pixel located in a portion (in a horizontal direction) where a pattern C is located and a luminance in a background display for a pixel in a portion (in a horizontal direction) where the pattern C is not located is normalized with a luminance in the background display. The crosstalk ratio is specified as a formula (2) where a luminance in the point A is L(AG) and a luminance in the point B is L(BG).

$$CTR=\{(L(AG)-L(BG))/L(AG)\}\times 100\ (\%) \quad (2)$$

Further, the contrast ratio specifies a ratio between a luminance in an arbitrary area on a screen, when in a whole area white is displayed and a luminance in an arbitrary area on a screen, when in a whole area black is displayed. Accordingly, the contrast ratio CR is specified as a formula (3) where a luminance at the point A when white is displayed in a whole area is L(AW) and a luminance at the point B when black is displayed in a whole area is L(AB).

$$CR=L(AW)/L(AB) \quad (3)$$

The contrast ratio is an index of the ratio of charging when a gate selecting period is completed. In other words, if a drain electrode is charged up to approximately 100% by the source voltage during a gate selecting period, a sufficient contrast ratio is obtained. Here, a conventional condition of gate-on voltage, $Vg^+$ is 15 V where a charging the drain electrode is fully completed, and a gate-on voltage, $Vg^+$, according to the present invention is 17 V.

TABLE 1

| $Vg^+$ (V) | CTR (%) | CR |
|---|---|---|
| 17 | 5 | 96 |
| 16 | 7 | 96 |
| 15 | 8 | 95 |
| 14 | 8.7 | 88 |
| 13 | 9.2 | 82 |
| 12 | 9.5 | 70 |

As shown in Table 1, when the conventional gate-on voltage is 15 V, the crosstalk ratio CTR is 8%. According to the present invention, since the gate-on voltage $Vg^+$ is increased up to 17 V, the crosstalk is improved down to 5%.

On the other hand, if the gate-on voltage $Vg^+$ is decreased from 15 V to 12 V, the contrast ratio CR is decreased from 95 to 70. However, even if the gate-on voltage $Vg^+$ is increased from 15 V to 17 V, the contrast ratio CR is increased from 95 to 96 and is little varied. Accordingly, since the conventional gate-on voltage $Vg^+$ equal to 15 V is a condition wherein charging the drain electrode is completed at the conclusion of a gate selecting period, $Vg^+$ equal to 17 V is a condition in the present invention where charging is completed during a half of the gate selecting period.

A characteristic of charging a TFT is improved by increasing $Vg^+$ as in the above-mentioned embodiment, but at the same time, the following problem arises.

A possibility where a transistor produces an electrical breakdown since a voltage between a gate electrode and a source electrode during TFT on state is enlarged. Further, since a varied value Δ Vgd, which is generated under the influence of a parasitic capacitance Cgd between a gate electrode and a source electrode, is in proportion to the parasitic capacitance Cgd as shown in the following formula (4), the value ΔVgd also becomes enlarged.

$$\Delta Vgd=(Cgd/(Cgd+Cst+Clc))\times(Vg^+-Vg^-) \quad (4)$$

where $Vg^-$ is a gate-off voltage shown in FIG. 2(*a*) through FIG. 2(*g*).

The above-mentioned problem may be solved at the same time by dividing a gate-on period to two periods and varying gate-on voltages for respective gate-on periods which are divided.

Figures 3A, 3B, 3C, 3D, 3E, 3F, 3G:
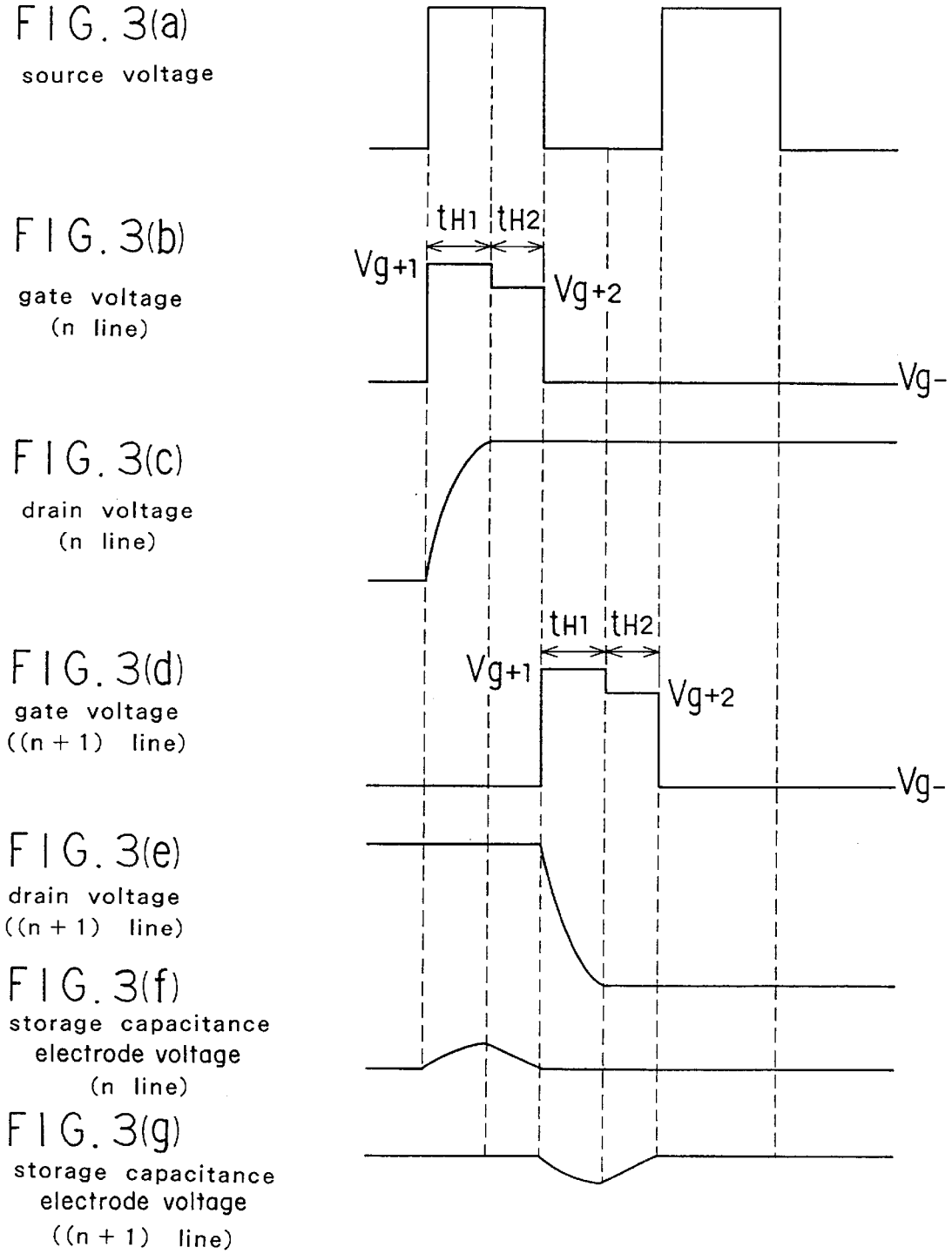
FIG. 3(*a*) through FIG. 3(*g*) illustrate respectively waveforms of the source voltage, of the gate voltage, of the drain voltage and of the storage capacitance voltage in a line inversion driving technique according to another embodiment of a method of driving the liquid crystal display apparatus of the present invention.

FIG. 3(*a*) through FIG. 3(*g*) illustrate respectively waveforms of the source voltage, of the gate voltage, of the drain voltage and of the storage capacitance electrode voltage in a line inversion driving technique in setting a charging period $(1/2)\times t_H$ and dividing a gate-on period to two periods and varying the respective gate-on voltage for respective gate-on periods to each other. Similarly to FIG. 2(*a*) through FIG. 2(*g*), FIG. 3(*a*) illustrates a source voltage; FIG. 3(*b*) illustrates a gate voltage for an n line; FIG. 3(*c*) illustrates a drain voltage for an n line; FIG. 3(*d*) illustrates a gate voltage for the n+1 line; FIG. 3(*e*) illustrates a drain voltage for the n+1 line; FIG. 3(*f*) illustrates a storage capacitance electrode voltage for the n line; and FIG. 3(*g*) illustrates a storage capacitance electrode voltage for the n+1 line.

In this embodiment, as shown in FIG. 3 a gate-on voltage to be applied to a TFT is set at a level $V_{g+1}$ for a first $t_{H1}$ period and is set at a level $V_{g+2}$ which is lower for the succeeding $t_{H2}$ period. $V_{g+1}$ is set so that charging the TFT can be completed within the period $t_{H1}$. With respect to $V_{g+2}$, it is accepted that $V_{g+2}$ is set at a voltage value capable of realizing an ON-state resistance, which is necessary for retaining a finally reached voltage within a first $t_{H1}$ period, of a TFT, since the drain voltage is not varied even if the drain voltage receives the influence of the recovery of the storage capacitance electrode voltage. For example, in order to complete within $(1/2)t_H$, it is accepted that $V_{g+1}$ is set at 18 V level and that $V_{g+2}$ is set at 13 V level.

Further, since it is also accepted that the gate-on period is not divided to two periods, a storage capacitance voltage can be recovered within the gate selecting period likely as in this embodiment by dividing the gate-on period to three or more periods and varying the respective gate-on voltages for respective gate-on periods, for example, in a manner wherein a gate voltage in a first period is set at a voltage wherein charging the drain electrode within the first period; and a gate voltage in a second period is set at a voltage value which is lower than a voltage value in the first period and realizes an electrical resistance necessary for retaining the finally reached drain voltage value in the first period; and a gate voltage in a third or latter period is set similarly. Accordingly, even if when the gate-on period is divided to three or more periods, a horizontal crosstalk in line inversion driving technique or in line common inversion driving technique can be decreased.

Next, as a method to achieve a crosstalk ratio such as in $Vg^+$ equal to 17 V shown in Table 1 under the condition of the convenitonal $Vg^+$ equal to 15 V, a method wherein a value of ON-state current is enlarged and charging time is shortened is explained hereinafter referred to FIG. 1(*a*) and FIG. 1(*b*).

Figure 1A:
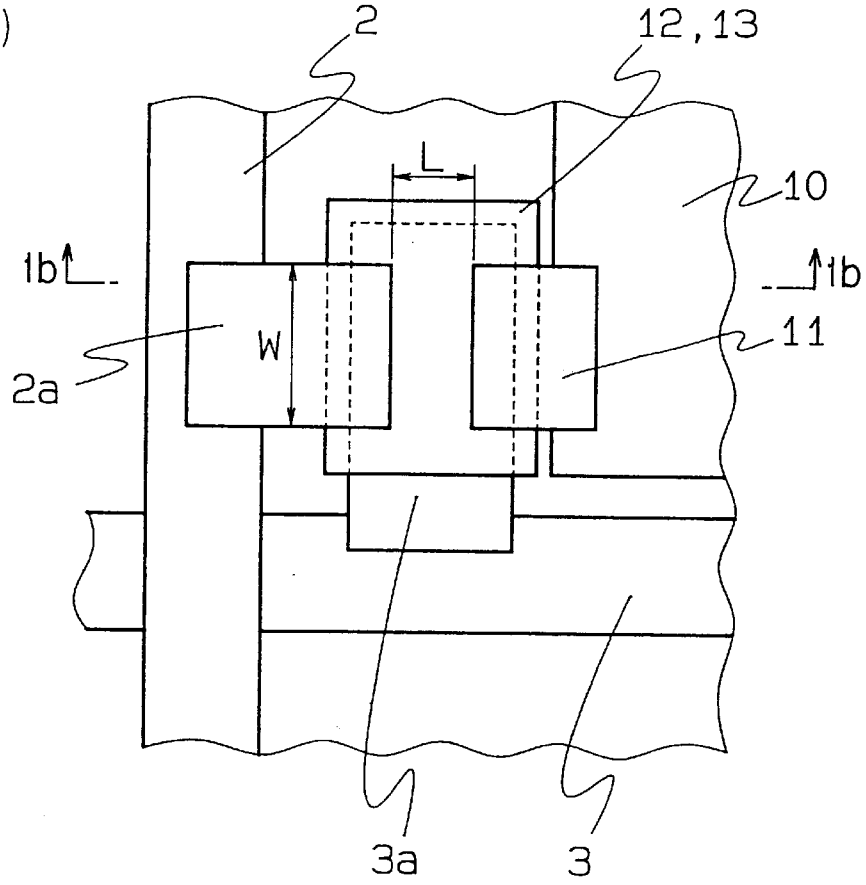
FIG. 1(*a*) is a plan view illustrating the liquid crystal display apparatus according to the present invention.
Figure 1B:
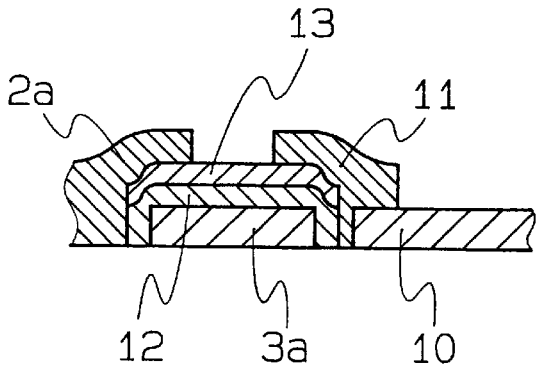

FIG. 1(*a*) is a plan view illustrating the liquid crystal display apparatus according to the present invention; FIG. 1(*b*) is a cross sectional view taken along a B—B line in FIG. 1(*a*).

In FIG. 1(*a*) and FIG. 1(*b*), reference numeral 2 indicates a source line, reference numeral 2*a* indicates a source electrode, reference numeral 3 indicates a gate line, reference numeral 3*a* indicates a gate electrode, reference numeral 10 indicates a pixel electrode, reference numeral 11 indicates a drain electrode. A TFT comprises the source electrode 2*a*, the gate electrode 3*a* and the drain electrode 11. The source line 2 and the source electrode can be formed in one-piece or can be formed respectively. The gate line 3 and the gate electrode 3*a* are also can be formed in one-piece or can be formed respectively. The pixel electrode 10 is connected electrically to the drain electrode 11. Further, a gate insulating film 13 and a semiconductor film 12 are sandwitched between the gate electrode and the source electrode and between the gate electrode and the drain electrode (see FIG. 1(*b*)).

With respect to the liquid crystal display apparatus according to the present invention, ON-state current value can be increased to twice the conventional value if the sizes of the TFT shown in FIG. 1(*a*) are varied so that a ratio W/L, where W represents a width of the source electrode in the TFT and L represents a distance between a source electrode and a drain electrode, is increased to twice the conventional designed value wherein charging the pixel electrode is completed within the conventional gate selection period. As a result, the charging time becomes approximately half, charging is completed within the gate selecting period. Among the sizes of the TFT, for example, if W equals to $2\times10^{-2}$ mm and L equals to $5\times10^{-3}$ mm, the ratio W/L is 4, at that time, charging time for the drain electrode is 13 $\mu$sec, that is, half a conventional charging time 26 $\mu$sec.

According to the driving method recited in claims 1 and 2 for the liquid crystal display apparatus of the present invention, since charging drain electrode (pixel electrodes) can be completed within a shorter period compared with a gate selecting period, a storage capacitance voltage varied by a coupling capacitance from the drain electrode (pixel electrode) can be recovered during the gate selecting period, and further a crosstalk in driving by the line inversion driving technique or in driving by the line common inversion driving technique can be reduced.

According to the driving method recited in claims 3 and 4 for the liquid crystal display apparatus of the present invention, among the plural periods to which the gate selecting period is divided, charging the drain electrodes is completed within the first period and a storage capacitance voltage can be recovered with keeping a pixel voltage unvaried. Further, since a period wherein a high gate voltage is applied can be shortened, a problem of breakdown in a transistor can be solved. Further, a flicker or an image-sticking caused under the influence of the parasitic capacitance Cgd between a gate electrode and a drain electrode can be reduced.

According to the liquid crystal display apparatus recited in claim 5 of the present invention, since charging the drain electrode (pixel electrode) is completed within a shorter period compared with the gate selecting period a varied storage capacitance voltage under the influence of the capacitive coupling effect from the drain electrode can be recovered within the gate selecting period and a horizontal crosstalk in driving by the line inversion driving technique or by the line common inversion driving technique can be reduced.

According to the driving method recited in claims 6 and 7 for the liquid crystal display apparatus of the present invention, among the plural periods to which the gate selecting period is divided, charging the drain electrode is completed within the first period and a storage capacitance voltage can be recovered with a voltage applied to a pixel being kept unvaried within the second period. Further, since a period in which a high gate voltage is applied can be shortened, the possibility of breakdown in a transistor can be suppressed and the influence of the fluctuation of the drain voltage generated by the influence of the parasitic capacitance Cgd between the gate electrode and drain electrode can be suppressed so that a horizontal crosstalk in driving by the line inversion driving technique or the line common inversion driving technique can be reduced.

It should be understood that the apparatus and methods which have been shown and described herein are illustrative of the invention and are not intended to be limitative thereof. Clearly, those skilled in the art may conceive of variations or modifications to the invention. However, any such variations or modifications which falls within the purview of this description are intended to be included therein as well. The scope of the invention is limited only by the claims appended hereto.

What is claimed is:

1. A method of driving a liquid crystal material in a liquid crystal display apparatus comprising steps of:

(1) charging a drain electrode of a thin film transistor with a source voltage by applying a gate voltage to a gate electrode of said thin film transistor and controlling said thin film transistor;

(2) retaining a drain voltage with the aid of a storage capacitance and a liquid crystal material capacitance; and (3) letting said thin film transistors ON-state by applying a voltage to said gate electrode in said thin film transistor and by inversing polarity of said source voltage in each gate selecting period, which comprises a step of:

reducing a horizontal crosstalk by setting said gate voltage so as to complete charging said drain electrode within the first period of a plurality of divided periods of the gate selecting period; and by restoring the fluctuation of a storage capacitance electrode voltage to its initial value at the beginning of said gate selecting period, within said gate selecting period.

2. The method of claim 1, wherein said first period is approximately one half of said gate selecting period.

3. The method of claim 1, wherein said gate selecting period is divided to two periods and a gate voltage in said first period is set at a voltage value wherein charging said drain electrode within said first period; and a gate voltage in a second period is set at a voltage value wherein an electrical resistance necessary for retaining a finally reached drain voltage value in said first period is realized.

4. The method of claim 1, wherein said gate selecting period is divided to three or more periods wherein a gate voltage in said first period is set at a voltage value in which charging said drain electrode is completed within said first period; a gate voltage in a second period is set at a voltage value which is lower than a voltage in said first period and realizes an electrical resistance necessary for retaining finally reached drain voltage value in said first period; and a gate voltage in a third or latter period is set similarly.

5. A liquid display apparatus comprising:

a plurality of source lines, a plurality of gate lines, a gate insulating film transistor, a drain electrode, a liquid crystal material, a storage capacitance, a capacitance formed by said liquid crystal material; said plurality of gate lines being formed in one direction; said plurality of source lines being formed in another direction; said gate line and said source line intersecting at a right angle through said gate insulating film; said thin film transistor being connected to each intersecting portion where said gate line and said source line intersect; drain voltage being retained by said storage capacitance and by said capacitance formed by said liquid crystal material, wherein the storage capacitance voltage is restored to its initial value at the beginning of a gate selecting period, within a gate selecting period by setting a gate voltage so as to charge said drain electrode within the first period of a plurality of divided periods of said gate selecting period.

6. The liquid crystal display apparatus of claim 5, wherein said first period is approximately one half of said gate selecting period.

7. The liquid crystal display apparatus of claim 5 wherein said gate selecting period is divided to two periods and a gate voltage in said first period is set at a voltage value wherein charging said drain electrode is completed within said first period; and a gate voltage in a second period is set at a voltage value wherein an electrical resistance necessary for retaining a finally reached drain voltage value in said first period is realized.

8. A liquid crystal display apparatus comprising:

a plurality of source lines, a plurality of gate lines, a gate insulating film, a thin film transistor, a drain electrode, a liquid crystal material, a storage capacitance, a capacitance formed by said liquid crystal material; said plurality of gate lines being formed in one direction; said plurality of source lines being formed in another direction; said gate line and said source line intersecting at a right angle through said gate insulating film; said thin film transistor being connected to each intersecting portion where said gate line and said source line intersect; drain voltage being retained by said storage capacitance and by said capacitance formed by said liquid crystal material;

wherein a width of a source electrode and a distance between said source electrode and said drain electrode are determined so as to charge said drain electrode within the first period of a plurality of divided periods of gate selecting period so that the storage capacitance voltage be restored to its initial value at the beginning of said first period, within said gate selecting period.

* * * * *